United States Patent [19]

Ikeda et al.

[11] 4,320,954

[45] Mar. 23, 1982

[54] DRIVE MECHANISM FOR AN IMAGE TRANSFER TYPE COPYING APPARATUS

[75] Inventors: Hiroshi Ikeda, Aichi; Koji Takeuchi, Gamagori, both of Japan

[73] Assignee: Minolta Camera Kabushiki Kaisha, Osaka, Japan

[21] Appl. No.: 108,273

[22] Filed: Dec. 28, 1979

[30] Foreign Application Priority Data

Jan. 9, 1979 [JP] Japan ..... 54-1467

[51] Int. Cl.[3] ..... G03G 15/00

[52] U.S. Cl. ..... 355/3 R; 355/3 DD; 355/8

[58] Field of Search ..... 355/3 R, 8, 3 DD, 11, 355/49, 60, 65, 66

[56] References Cited

U.S. PATENT DOCUMENTS

| | | | |
|---|---|---|---|
| 3,743,274 | 7/1973 | Komori | 355/8 |
| 4,007,986 | 2/1977 | Komori et al. | 355/8 X |
| 4,124,288 | 11/1978 | Zeuthen | 355/8 |

*Primary Examiner*—Richard L. Moses

*Attorney, Agent, or Firm*—Wenderoth, Lind & Ponack

[57] ABSTRACT

The invention disclosed relates to a drive mechanism for an image transfer type copying apparatus which comprises first and second drive sources independent of one another. The first drive source is for driving photosensitive member and scanning movement of original scanning means whereas the second drive source is for driving developing means and return movement of original scanning means so as to prevent slippages in synchronism and in image transfer cause by a shock or impact generated at the time of initiation of return movement of scanning means or at the times of initiation and stop of the developing means.

5 Claims, 6 Drawing Figures

DRIVE MECHANISM FOR AN IMAGE TRANSFER TYPE COPYING APPARATUS

BACKGROUND OF THE INVENTION

The present invention relates to a drive mechanism for an image transfer type copying apparatus, and more particularly to a drive mechanism suitable for high speed copying with accuracy in synchronism maintained.

As a drive system for an image transfer type copying apparatus, it has been a general practice to employ a single drive source to drive all the elements necessary for copying such as an original scanning means, a photosensitive member, a developing means and a feeding means for copying paper. In order to achieve high speed copying in this type of copying apparatus, it is generally necessary to increase scanning and return speeds of the original scanning means and in particular requires the speed of return movement to be increased. However, the problem may arise in this case that if a shock or an impact at the change of the scanning means from the scanning movement to the return movement is large, variance in moving speed of the photosensitive member will be caused which in turn causes the slippage of image transfer onto copying paper resulting in poor transfer of image. Additionally, there is a necessity to provide relatively large sized developing means in order to increase capacity for developer in high speed copying and this will inevitably increase the drive torque of the developing means. As a result, sudden changes in loads will occur at the times of energization and deenergization of drive for the developing means which in turn causes changes in speeds of the scanning means, photosensitive member, feeding means and other elements so that the final copy obtained will have an image with slippages in synchronism and image transfer. Accordingly, the slippages in synchronism as well as in image transfer caused by return movement of the original scanning means, or by energization and deenergization of the developing means will influence the copying operation either directly or indirectly through the drive source by large changes in loads so that these defects or disadvantages were basically unavoidable in the conventional high speed copying apparatus with a single drive source to drive all the elements.

SUMMARY OF THE INVENTION

It is accordingly a primary object of the present invention to provide a novel and improved drive mechanism for an image transfer type copying apparatus free of the aforedescribed drawbacks.

Another object of the present invention is to provide a novel and improved drive mechanism for an image transfer type copying apparatus which is effective to prevent slippages in synchronism as well as in image transfer.

Still another object of the present invention is to provide an improved drive mechanism for an image transfer type copying apparatus which has a relatively simple construction and is efficient in driving necessary means for performing copying operation.

These and other objects of the present invention are achieved by providing a drive mechanism suitable for a high speed copying apparatus which comprises a first drive source for driving at least the forward or scanning movement of the original scanning means as well as the rotation of the photosensitive member and a second drive source independent of the first drive source for driving at least the return movement of the scanning means and the developing means.

For a fuller understanding of the nature and objects of the present invention, reference is made to the following detailed decription taken in conjunction with the accompanying drawings.

DESCRIPTION OF THE PREFERRED EMBODIMENTS

Figure 1:
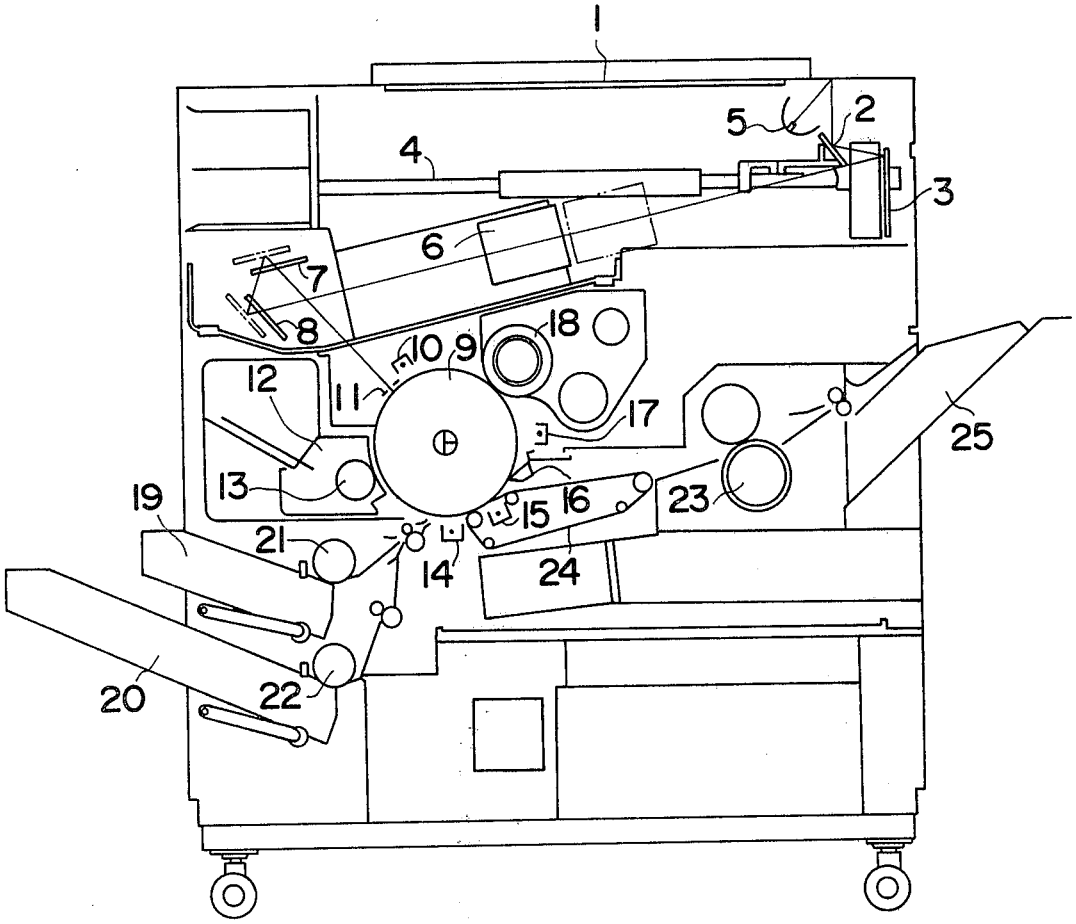
FIG. 1 is a diagrammatic cross-sectional view of an image transfer type copying apparatus in which the drive mechanism in accordance with the present invention may be provided.

Referring to FIG. 1 which shows an image transfer type electrophotographic copying apparatus capable of producing copies at high speed, there is provided at its top portion an original supporting glass plate 1 for placing an original to be copied. The image of the original is scanned by an optical system or an original scanning means of the reciprocatingly movable type which includes first and second reflecting mirrors 2 and 3 movably supported on a guide rod 4 and a lamp carriage 5 integrally movable with the first reflecting mirror 2. As is well known in the art, the first reflecting mirror 2 together with the lamp carriage 5 is moved parallelly with respect to the glass plate 1 for scanning the original with the second reflecting mirror 3 following the movement of first reflecting mirror 2 at one half the speed thereof. The image of the original successively projected by the first and second reflecting mirrors 2 and 3 is then projected through a lens 6 and reflected by first and second fixed mirrors 7 and 8 for projection onto a photosensitive member 9 rotating in the counter-clockwise direction. Upon termination of scanning of the original, the first and second reflecting mirrors 2 and 3 are returned to their initial position at high speed for preparation for the next scanning. It should be noted that while the rotational speed of photosensitive member 9 is same as the moving speed of first reflecting mirror 2 when effecting copying at a 1 to 1 copying ratio, the speed of first reflecting mirror 2 will be varied in accordance with the selected magnification factor with the lens as well as the first and fixed mirrors 7 and 8 shifted to positions shown by single dot lines when effecting copying at a ratio of other than 1 to 1.

About and around the photosensitive member 9 in the form of a drum, are provided a corona charging means 10 for uniformly charging the surface of photosensitive member 9, an exposure slit 11 through which the image of the original is projected, a developing means 12 including a rotatable developer roller 13 for developing an electrostatic latent image formed on the photosensitive member 9, an image transferring means 14 of a corona discharger for transferring the developed image onto a copying paper, a stripping means including an A. C. corona discharger 15 and a pawl 16 for separating the copying paper, an erasing lamp 17 for erasing the residual charges from photosensitive member 9 and a cleaning means 18 in the form of a fur brush for cleaning residual toner. These are provided sequentially in the rotational direction of the photosensitive member 9.

Copying papers of different size are respectively stored in first and second paper cassettes 19 and 20 and are fed one by one by feeding rollers 21 and 22. The paper fed either by feeding roller 21 or 22 is transported to the image transferring means 14 where a developed image is transferred and then separated from the photosensitive member 9 by said stripping means. After the separation, the copying paper is fed between a pair of fusing rollers 23 by an endless transporting belt 24 and finally discharged out of the apparatus onto a receiving tray 25.

Figure 2:
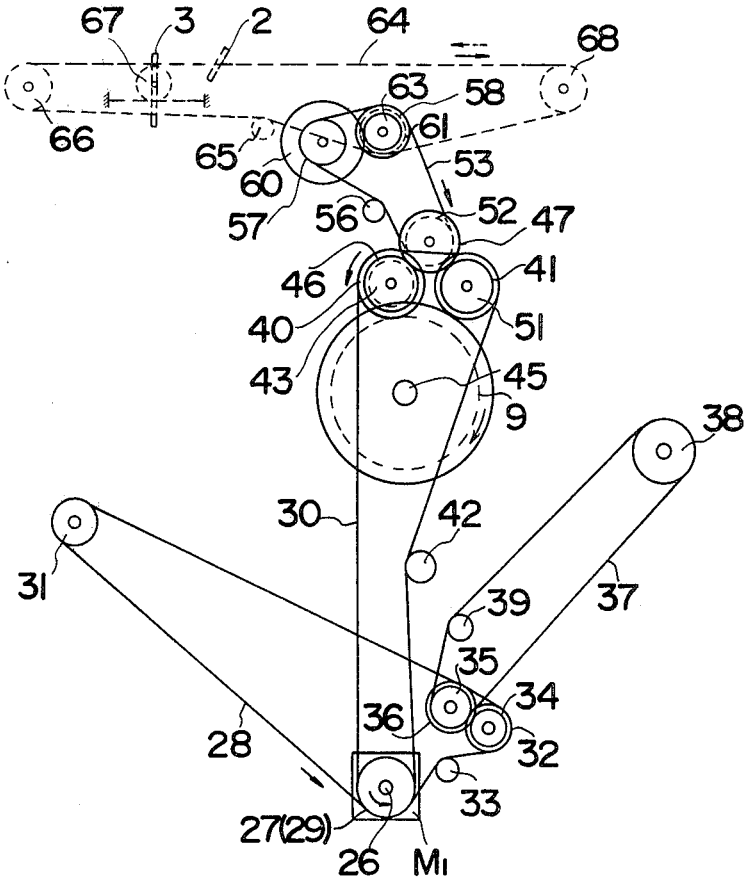
FIG.2 Prior Art
FIG. 2 is a sectional view of a conventional drive mechanism driven by a single drive source.
Figure 3:
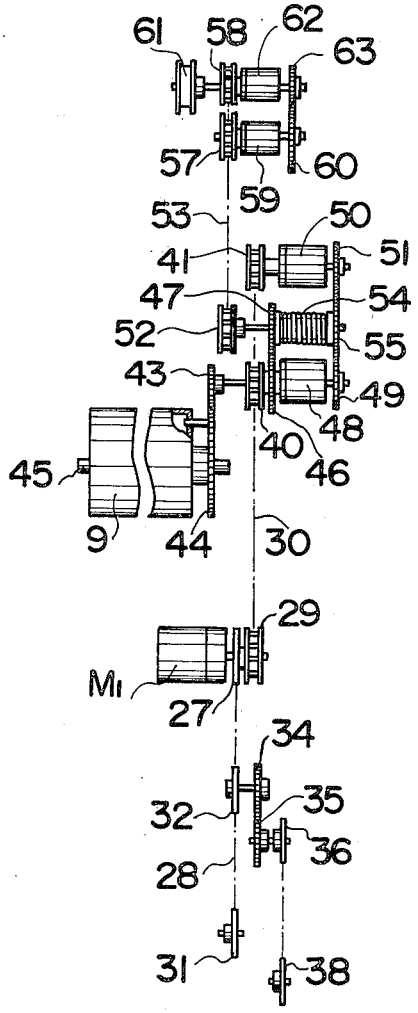
FIG.3 Prior Art
FIG. 3 is a side view of the drive mechanism as viewed from left of FIG. 2 with positions of some elements altered for a better view.

Referring now to FIGS. 2 and 3, there is shown a conventional drive mechanism assembled in the copying apparatus of FIG. 1 for driving basically all the elements necessary for copying by a single drive source. Before proceeding further, it will be noted that some elements or mechanism shown in FIG. 3 which is a side view as viewed from the left of FIG. 2 are somewhat displaced or altered for a more clear understanding. In FIGS. 2 and 3, a main motor M1 which is the single drive source includes on its drive shaft 26 a drive sprocket 27 with which a first endless chain 28 is engaged and a drive pulley 29 with which a first timing belt 30 is engaged. The first endless chain 28 is wound over a fuser roller sprocket 31 on the axis of fusing roller 23, a paper feeding sprocket 32 on the axis of feeding roller 21 or 22 and a tension sprocket 33 so as to drive the fusing rollers 23 and feeding roller 21 or 22 by its rotation. Although not shown, this endless chain 28 also drives a transporting means leading to the image transferring means 14 as well as the endless transporting belt 24 leading to the fusing rollers 23. Additionally, the paper feeding sprocket 32 has on its axis a clutch (not shown) for intermittently driving the feeding roller 21 or 22 and also a first transmission gear 34 in meshing engagement with a second transmission gear 35. On the same shaft carrying the gear 35, a second drive sprocket 36 is provided with which a second endless chain 37 is engaged for driving a developer roller sprocket 38 which drives the developer roller 13 of the developing device 12 and also for driving a tension sprocket 39. It should be noted that there is provided a clutch (not shown) for driving the developer roller 13 only during the passage of an electrostatic latent image formed on the photosensitive member 9 therethrough.

On the other hand, the first timing belt 30 driven by the drive pulley 29 is wound over a drum driving pulley 40, a magnification driving pulley 41, a tension pulley 42 and said drive pulley 29. The drum driving pulley 40 carries on its shaft a first drum gear 43 in mesh with a second drum gear 44 carried by a drum shaft 45 for driving the photosensitive member 9 and a first scan driving gear 46 in mesh with a second scan driving gear 47 for driving the first and second reflecting mirrors 2 and 3. As more clearly shown in FIG. 3, a shaft supporting the drum driving pulley 40 also carries along with those gears a first clutch 48 and a first gear 49. This first clutch 48, when energized, controls the scanning speed of first reflecting mirror 2 suitable for copying at a first reduction ratio of, for example, 1 to 0.816 as will be further explained hereinbelow.

Meanwhile, the magnification driving pulley 41 carries on the same shaft a second clutch 50 and a second gear 51 for controlling the scanning speed of first reflecting mirror 2 suitable for copying at a second reduction ratio of 1 to 0.707. The second scan driving gear 47 which is in mesh with the first scan driving gear 46 carries therewith a scan driving pulley 52 with which a second timing belt 53 is engaged, a spring clutch 54 for rotating the gear 47 in either direction in accordance with the energization of either the first or second clutch 48, 50 and a third gear 55 in mesh with both the first and second gears 49 and 51. The second timing belt 53 is also wound in endless form over a tension pulley 56, a return pulley 57 and a scan pulley 58. The return pulley 57 carries on its shaft a return clutch 59 and a return gear 60 for driving the first and second reflecting mirrors 2 and 3 back to their initial positions at high speed after the termination of scanning of the original whereas the scan pulley 58 carries on its shaft a wire driving pulley 61, a scan clutch 62 and a scan gear 63 for driving the first and second reflecting mirrors 2 and 3 for scanning at a predetermined speed. In addition, a wire 64 connected to the first and second reflecting mirrors 2 and 3 and driven by said wire driving pulley 61 is wound over a tension pulley 65, a first pulley 66, a mirror pulley 67 and a second pulley so as to enable the movements of first and second reflecting mirrors 2 and 3 at a speed ratio of 1 to ½.

Thus, at a copying ratio of 1 to 1, the drive force from the main motor M1 to the wire driving pulley 61 for driving the first reflecting mirror 2 at a speed the same as the speed of photosensitive member 9 is transmitted to the drum driving pulley 40 through the first timing belt 30, first and second scan driving gears 46 and 47, scan driving pulley 52 and to the scan pulley 58 through the second timing belt 53. On the other hand, at a first reduction copying ratio of 1 to 0.816 at which the first clutch 48 is energized, the drive force to the wire driving pulley 61 for moving the first reflecting mirror 2 at speed of 1/0.816 the speed of photosensitive member 9 is transmitted from the main motor M1 to the drum driving pulley 40, first clutch 48, first and third gears 49 and 55 in mesh with each other scan driving pulley 52 and to the scan pulley 58 carrying the wire driving pulley 61. Similarly, at a second reduction copying ratio of 1 to 0.707 at which the second clutch 50 is energized for controlling the speed of first reflecting mirror 2 to 1/0,707 the speed of photosensitive member 9, the drive force from the main motor M1 to the wire driving pulley 61 is transmitted through the magnification driving pulley 41 by way of the first timing belt 30, second clutch 50, second and third gears 51 and 55 in mesh with each other, spring clutch 54, scan driving pulley 52 and to the scan pulley 58. At the occasion of deenergization of the scan clutch 62 and energization of the return clutch 59 for driving the first and second reflecting mirrors 2 and 3 back to their initial positions at high speed, the drive force to the wire driving pulley 61 is transmitted by way of return pulley 57, return clutch 59, return and scan gears 60 and 63 and to the wire driving pulley 61.

Explaining now briefly the operation of the copying apparatus provided with the drive mechanism described above, the actuation of a print switch (not shown) energizes the main motor M1 to drive the first and second endless chains 28 and 37 as well as the first timing belt 30. By this, the photosensitive member 9 is rotated and immediately thereafter, the scan clutch 62 is energized to begin the scan of first and second reflecting mirror 2 and 3. As has been described, either the first or second clutch 48 or 50 will be energized simultaneously in case the copying at reduction mode of 1 to 0.816 or 1 to 0.707 is selected. Shortly thereafter, a clutch for feeding roller 21 or 22 is energized to feed the copying paper. As the original is scanned, an electrostatic latent image is successively formed on the photosensitive member 9 and at the time the leading edge of latent image arrives at the developing station, a clutch for the developer roller 13 is energized to rotate the same for development of the latent image. As noted, the same clutch is deenergized immediately after termination of development. The developed image is then transferred and the copying paper is fed to the fusing rollers 23.

Upon termination of scanning of the original, the scan clutch 62 carried by the scan pulley 58 is deenergized to halt the scanning movements of first and second reflecting mirrors 2 and 3 and in turn energizes the return clutch 59 on the shaft of return pulley 57 in order to move the first and second reflecting mirrors back to their initial positions at high speed. However, this change-over from deenergization of scan clutch 62 to energization of return clutch 59 generates a shock or impact which will be transmitted through the second timing belt 53 and the first timing belt 30 thereby providing a bad effect on the drum shaft 45 causing a change in rotational speed of the photosensitive member 9 which results in uneven development of the latent image as well as in slippages during the transfer of the image onto the copying paper. Similarly, energization and deenergization of the clutch for developer roller 13 at the beginning and at completion of development will cause sudden and large changes in loads. Such changes in loads influence the main motor M1 through the second endless chain 37 which in turn causes the changes in moving speeds of the photosensitive member 9 and first and second reflecting mirrors 2 and 3 through the first timing belt 30 thereby resulting in slippages in transfer of the image as well as in synchronism so that the quality of the copied image obtained is quite poor.

In accordance with the present invention, the drive source is divided into at least first and second drive sources with the first drive source driving at least the photosensitive member and forward movement of the original scanning means and the second drive source driving at least the developing means and return movement of the original scanning means. An embodiment of this drive mechanism will now be described with references made to FIGS. 4 and 5. For parts functioning identically with those shown in FIGS. 2 and 3, the same numerals will be used in its description.

Figure 4:
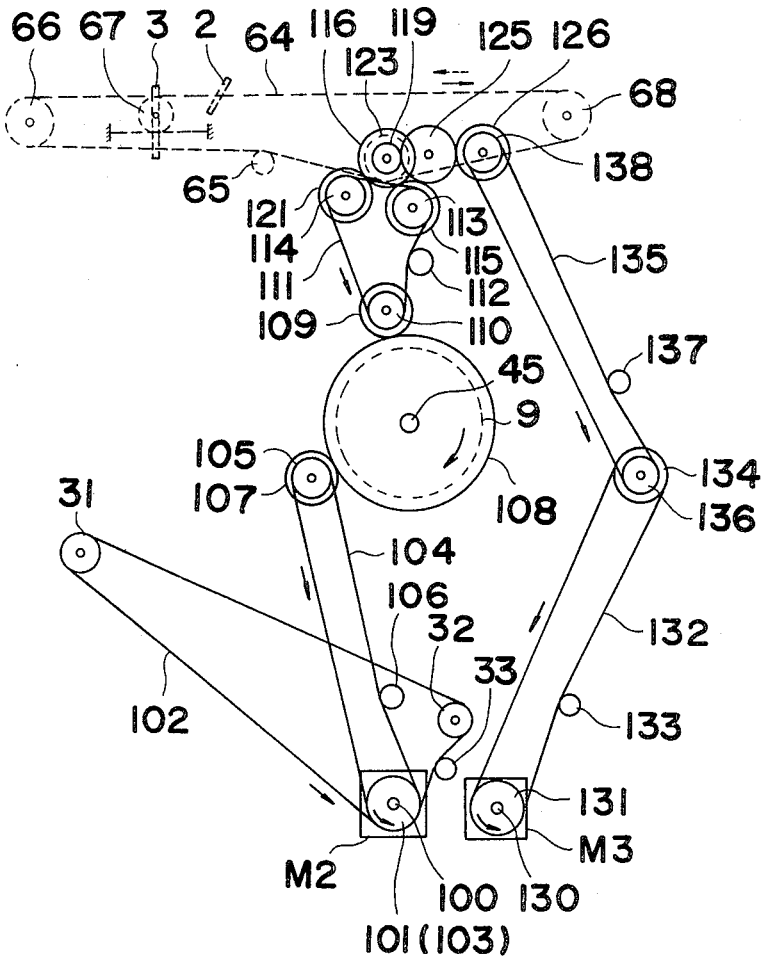
FIG. 4 is a sectional view of a drive mechanism in accordance with the present invention which is driven by at least two drive sources.
Figure 5:
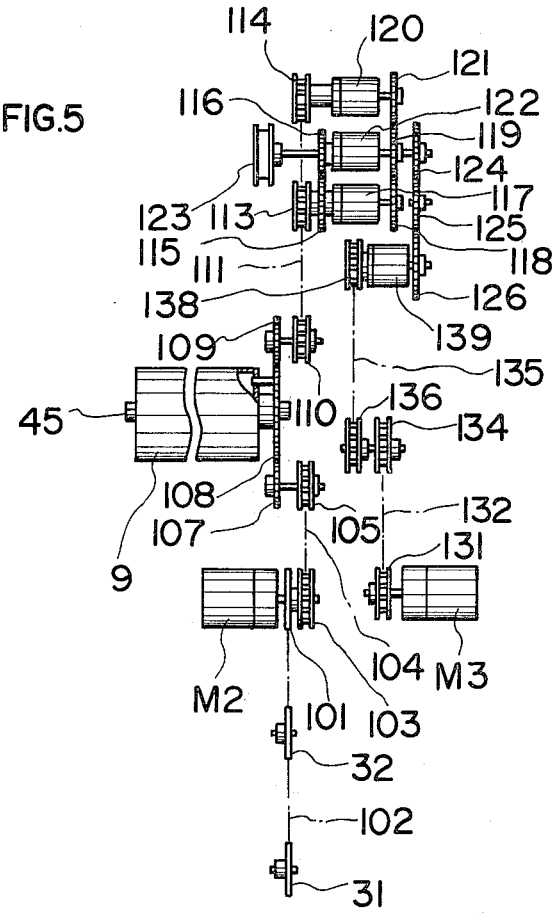
FIG. 5 is a side view of the drive mechanism as viewed from left of FIG. 4 with positions of some elements altered for a better view.

Referring to FIGS. 4 and 5, M2 designates a first drive source or first motor having a drive shaft 100 carrying a drive sprocket 101 with which a first endless chain 102 is engaged and a drive pulley 103 with which a first timing belt 104 is. Similar to the conventional drive mechanism shown in FIGS. 2 and 3, the first endless chain 102 is wound over the fuser roller sprocket 31, the paper feeding sprocket 32 and the tension sprocket 33 for driving the fusing rollers 23 and paper feeding roller 21 or 22 as well as other paper transporting means. As has been described, a clutch is provided on the axis of paper feeding sprocket 32 to intermittently drive the paper feeding roller 21 or 22.

The first timing belt 104 driven by the first motor M2 is for driving the photosensitive member 9 as well as for driving the forward or scan movement of the first and second reflecting mirrors 2 and 3 and is wound over a drum driving pulley 105, a tension pulley 106 and said drive pulley 103. The drum driving pulley 105 carries on its shaft a first drum gear 107 in mesh with a second drum gear 108 provided rotatably on the drum shaft 45 for driving the photosensitive member 9. In mesh also with the second drum gear 108 is a drum driven gear 109 carrying on its shaft a scan driving pulley 110 with which a second timing belt 111 is engaged. This belt 111 is also rotatably carried in endless form over a tension pulley 112, a first magnification pulley 113 and a second magnification pulley 114. As more clearly shown in FIG. 5, the first magnification pulley 113 includes on its shaft a first scan driving gear 115 in mesh with a wire driving gear 116, a first clutch 117 the same as the clutch 48 described in connection with FIG. 3 for controlling the speed of first reflecting mirror 2 suitable for copying at ratio of 1 to 0.816 and a first gear 118 in mesh with a third gear 119. The second magnification pulley 114, on the other hand, includes a second clutch 120 functioning identically to the clutch 50 for controlling the scanning speed of first reflecting mirror 2 suitable for copying at ratio of 1 to 0.707 and a second gear 121 in mesh with the third gear 119. A shaft carrying this third gear 119 also include a scan clutch 122 which is energized to drive the first and second reflecting mirrors 2 and 3, the wire driving gear 116 in mesh with the first scan driving gear 115, a wire driving pulley 123 for driving a wire 64 connected to said mirrors 2 and 3 and also a transmission gear 124 in mesh with an intermediate gear 125 which in turn is in mesh with a return gear 126 as will be further explained hereinafter.

The wire 64 driven by the wire driving pulley 123 is connected to the first and second reflecting mirrors 2 and 3 in the same manner as described in connection with FIGS. 2 and 3 so that a detailed description thereof will be omitted.

With the first motor M2 being the drive source for at least the rotation of photosensitive member 9 and the scanning movement of first and second reflecting mirrors 2 and 3 on the one hand, a second motor M3, on the other hand, is a drive source for driving the developer roller 13 as well as for the return movement of said mirrors 2 and 3. More specifically, this second motor M3 has a drive shaft 130 carrying therewith a drive pulley 131 with which a third timing belt 132 is engaged. This timing belt 132 is also wound over a tension pulley 133 and a developer roller pulley 134 for driving the developer roller 13 directly by the rotation of belt 132, that is directly by the second motor M3. Drive force from the second motor M3 is also transmitted to a fourth timing belt 135 wound in endless form over a driven pulley 136, a tension pulley 137 and a return pulley 138. This return pulley 138 has also on its shaft a return clutch 139 which is energized to drive first and second reflecting mirrors 2 and 3 back to their initial positions after termination of scan movements and the return gear 126 in mesh with the intermediate gear 125 as described above.

The drive mechanism in accordance with the present invention being arranged as described above, the drive force from the first motor M2 to the wire driving pulley 123 for scan driving the mirrors 2 and 3 is transmitted in the following manner for each of the copying modes. Specifically, at a copying ratio of 1 to 1 wherein the first reflecting mirror 2 is moved at a speed equal to the speed of photosensitive member 9, the drive force from the first motor M2 is transmitted by way of the drive pulley 103, drum driving pulley 105 through the first timing belt 104, first and second drum gears 107 and 108, drum driven gear 109, scan driving pulley 110, first magnification pulley 113 through the second timing belt 111 and the first scan driving gear 115 in mesh with the wire driving gear 116 which in turn drives the wire driving pulley 123. On the other hand, at a first reduction copying ratio of 1 to 0.816 at which the first clutch 117 is energized to drive the first reflecting mirror 2 at 1/0.816 the speed of photosensitive member 9, the drive force transmitted to the first magnification pulley 113 as in the manner described above is further transmitted to the wire driving pulley 123 by way of the first clutch 117, first gear 118 and the third gear 118 in mesh with the first gear 119. Similarly, a second reduction copying ratio of 1 to 0.707 wherein the second clutch 120 is energized to drive the first reflecting mirror 2 at 1/0.707 the speed of photosensitive member 9, the drive force transmitted to the second magnification pulley 114 is further transmitted by way of the second clutch 120, second gear 121, third gear 119 in mesh with the second gear 121 and to the wire driving pulley 123.

To return the first and second reflecting mirrors 2 and 3 to their initial positions upon termination of scanning movements, the return clutch 139 will be energized with the scan clutch 122 deenergized. By this, the wire driving pulley 123 will be rotated in the opposite direction by receiving the drive force through the transmission gear 124, intermediate gear 125 and the return gear 126 in mesh with one another. As noted, the drive force to the return gear 126 is transmitted from the second motor M3 by way of the third timing belt 132, driven pulley 136 and the return pulley 138 through the fourth timing belt 135. Meanwhile, the developer roller 13 driven by the third timing belt 132 is controlled by directly energizing and deenergizing the second motor M3 so that the rotation of developer roller 13 is effected by energizing the second motor M3 at a suitable time, i.e., at the time of arrival of the leading edge of electrostatic latent image to the developing means 12 and the stopping of its rotation is effected by directly deenergizing the second motor M3 after termination of return movements of first and second reflecting mirrors 2 and 3 to their initial positions. Needless to say, a clutch for the developer roller 13 may be provided for more precisely controlling the rotation of said roller 13.

Thus, in the copying apparatus of FIG. 1 assembled with the drive mechanism shown in FIGS. 4 and 5, a shock or impact caused by deenergization of the scan clutch 122 upon termination of scanning and by energization of the return clutch 139 for initiating return movements of mirrors 2 and 3 will mostly be transmitted to the fourth timing belt 135 so that there will be no fear of causing changes in the speed of photosensitive member 9 as well as the slippages during the transfer of an image onto copying paper. Additionally, since the rotation of developer roller 13 is effected by the second motor M3 separate from the first motor M2 which drives the photosensitive member 9 and mirrors 2 and 3, there will be no effect on the drive of photosensitive member and mirrors so that slippages in synchronism as well as in image transfer will not occur upon initiation and termination of the rotation of developer roller 13. These and other advantages are attained by providing the second motor M3 for driving at least the return movement of original scanning means and the rotation of developing means which is separate and independent of the first motor M2 driving at least the photosensitive member and the scan or forward movement of the original scanning means.

Figure 6:
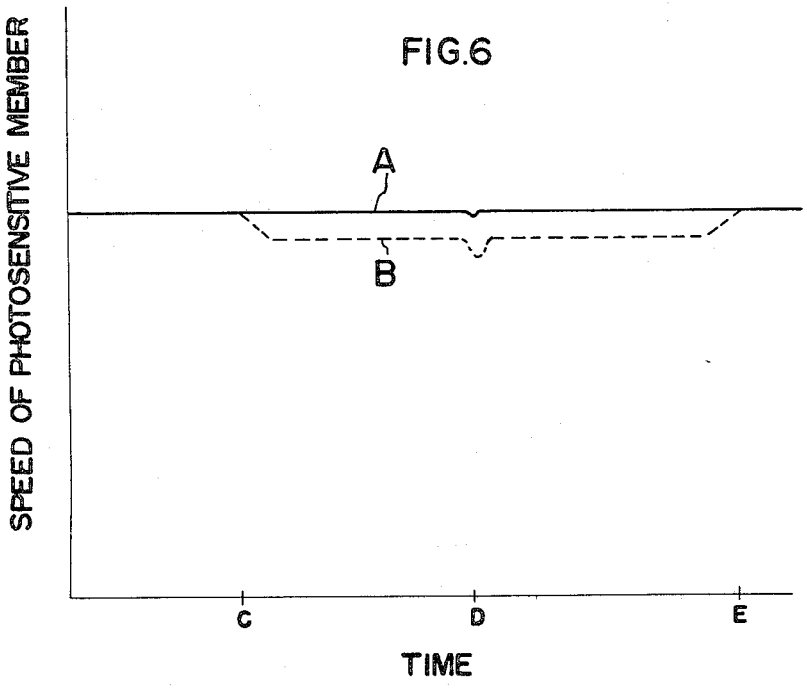
FIG. 6 is a graph showing speed changes of the photosensitive member driven by a conventional drive mechanism and by that of present invention.

Referring now to FIG. 6, the graph shows a comparison of change of drive speed of the photosensitive member 9 in accordance with the drive mechanism of the present invention and that of a conventional drive mechanism. In the drawing, the vertical axis designates the drive speed of photosensitive member 9 whereas the horizontal axis designates a time and curves A and B respectively represent the speed of photosensitive member 9 driven by the drive mechanism of the present invention and by the conventional drive mechanism. At time C wherein the rotation of developer roller 13 is initiated, it is seen that there is caused a relatively large change in the speed of photosensitive member 9 by the conventional drive mechanism. However, there is no such change in the present invention because the drive source (i.e., second motor M3) for rotating the developer roller 13 is independent of another drive source (i.e., first motor M2) which drives the photosensitive member 9. Similarly, at time D wherein the return clutch 59 or 139 is energized to return first and second reflecting mirrors 2 and 3, the conventional drive mechanism causes an even larger change in the speed whereas hardly any change is observed in the drive mechanism of the present invention. While some change in speed is caused even by the present invention, this is merely a minute vibration transmitted through the body proper of the copying apparatus which can be ignored. Additionally, there is seen a notable difference between the conventional drive mechanism and that of the present invention at time E at which the rotation of developer roller 13 is stopped.

While the present invention has been described in connection with a copying apparatus in which the optical system is reciprocatingly movable, it is noted that the apparatus may be an original carriage movable type or other types known in the art. Also, the present invention is in no way limited to a copying apparatus with only two motors but a few other motors such as for cleaning means and cooling fan may be provided. In principle, the present invention is sufficient as long as the drives for return movement of the original scanning means and developing means are made independent and separate from other drives.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A drive mechanism for an image transfer type copying apparatus which comprises;

an original scanning means movable in one direction for scanning an image of original to be copied and returnable in the opposite direction to its initial position;

a rotatable photosensitive member and including therearound at least a charging means for uniformly charging the surface of the photosensitive member, an exposure slit through which the image of an original is successively projected, a rotatable developing means for developing an electrostatic latent image formed on the photosensitive member, an image transfer means for transferring the developed image onto copying paper and a cleaning means for removing residual toner;

a first drive means including a first motor for rotating said photosensitive member and for forwardly moving said original scanning means, said original scanning means being moved for scanning as a scan clutch therefor is energized: and a second drive means including a second motor independent of said first motor for driving said developing means and for reversably moving said original scanning means, said original scanning means being moved in the reverse direction for return as said scan clutch is deenergized when a return clutch is energized.

2. The drive mechanism as claimed in claim 1 wherein the rotation of said developing means is controlled directly by energization and deenergization of said second motor with deenergization thereof occurring following the termination of return movement of said original scanning means.

3. A driven mechanism for an image transfer type copying apparatus which comprises:

an original scanning means movable in a forward direction for scanning an image of an original to be copied and returnable in a reverse direction to its initial position, said original scanning means being moved in said forward direction when a scan clutch therefor is energized and in said reverse direction when a return clutch therefor is energized;

a rotatable photosensitive member having positioned therearound at least a charging means for uniformly charging the surface of the photosensitive member, an exposure slit through which the image of the original is successively projected, a rotatable developing means for developing an electrostatic latent image formed on the photosensitive member, and image transfer means for transferring the developed image onto copying paper and a cleaning means for removing residual toner;

a paper feeding means for feeding the copying paper;

a first drive means including a first motor for rotating said photosensitive member, for driving said paper feeding means and for forwardly moving said original scanning means; and a second drive means including a second motor independent of said first motor for driving said developing means and for reversably by moving said original scanning means.

4. The drive mechanism as claimed in claim 3 further comprising a clutch means through which said paper feeding means is driven by said first motor.

5. The drive mechanism as claimed in claim 3 wherein the rotation of said developing means is controlled directly by energization and deenergization of said second motor with deenergization thereof occurring following the termination of return movement of said original scanning means.

* * * * *